US008997360B2

(12) United States Patent
Hall

(10) Patent No.: US 8,997,360 B2
(45) Date of Patent: Apr. 7, 2015

(54) DEVICE AND METHOD FOR ALIGNING HINGES ON DOOR DURING INSTALLATION

(71) Applicant: Tommy E. Hall, Bunker Hill, WV (US)

(72) Inventor: Tommy E. Hall, Bunker Hill, WV (US)

( * ) Notice: Subject to any disclaimer, the term of this patent is extended or adjusted under 35 U.S.C. 154(b) by 0 days.

(21) Appl. No.: 14/143,761

(22) Filed: Dec. 30, 2013

(65) Prior Publication Data

US 2014/0182154 A1 Jul. 3, 2014

Related U.S. Application Data

(60) Provisional application No. 61/747,674, filed on Dec. 31, 2012.

(51) Int. Cl.
*E04F 21/04* (2006.01)
*E04F 21/00* (2006.01)

(52) U.S. Cl.
CPC ..... *E04F 21/0007* (2013.01)

(58) Field of Classification Search
USPC ..... 33/194, 533, 613, 645
See application file for complete search history.

(56) References Cited

U.S. PATENT DOCUMENTS

| | | | | |
|---|---|---|---|---|
| 6,928,713 | B2 * | 8/2005 | Baer | 33/645 |
| 8,677,636 | B2 * | 3/2014 | Kelley | 33/194 |
| 2003/0005589 | A1 * | 1/2003 | Hale et al. | 33/194 |
| 2004/0000061 | A1 * | 1/2004 | Tuthill | 33/194 |
| 2007/0227016 | A1 * | 10/2007 | Tarter | 33/194 |
| 2012/0017452 | A1 * | 1/2012 | Lam et al. | 33/194 |
| 2013/0333296 | A1 * | 12/2013 | Lyons et al. | 33/194 |
| 2014/0259716 | A1 * | 9/2014 | Brandt | 33/533 |

* cited by examiner

*Primary Examiner* — G. Bradley Bennett
(74) *Attorney, Agent, or Firm* — Birch, Stewart, Kolasch & Birch, LLP

(57) ABSTRACT

An alignment device allows hinges from an old door being replaced to be transferred to a new door in the corresponding position to ensure that the new door is properly aligned in the door frame. The tool has an elongate channel that is placed next to the door in the height direction. A stopper aligns a comparable tool with a top edge of the door having its hinges removed. Brackets secure the channel to the door and ensure that the channel is parallel to the door. Once the tool is fixed relative to the door, the hinges can be attached to the channel. After the hinges are attached to the channel, they are removed from the existing door. The tool can now use to install hinges on a new door at a remote time or place from the hinges.

8 Claims, 2 Drawing Sheets

DEVICE AND METHOD FOR ALIGNING HINGES ON DOOR DURING INSTALLATION

This application claims the benefit of provisional application 61/747,674, filed Dec. 31, 2012, the contents of which are incorporated by reference.

BACKGROUND OF THE INVENTION

When new doors are added to a structure, they are often "pre-hung" in a door frame. In this way, the door frame fits within the rough opening of the structure and the door is aligned within the frame. Problems arise when a door must be replaced and the frame is not to be replaced. A door may be replaced due to damage to the door or to change the style of the door to more closely match the room. If the door is to be replaced without replacing the entire frame, the door must fit within the frame. In addition, the hinges on the new door should align with the position of the hinges on the existing door, as the frame has recesses allowing the hinges to be flush with the frame.

One technique for transferring the position of the hinges of the existing door to a new door entails laying the existing door on top of the new door with their respective top edges aligned. In order to do so, all hardware, such as locks and door knobs, must be removed from both doors. Once the two doors are in a stacked relation, the position of the hinges on the old door are transferred to the new door. This technique is time-consuming and requires that both doors be present at the same time and place.

There needs to be a way to correctly align the hinges on a new door so that, when the hinges are installed in the recesses on the frame, the new door does not hit the top of the frame.

It is an object of the invention to provide a tool for transferring images from an old door to a new door such that the hinges are placed at first positions corresponding to a position on the existing door.

It is another object invention to provide a tool for transferring hinges from the existing door to a new door at a remote time or place.

It is still another object invention to provide a tool for transferring hinges to a new door that is easy to manufacture and transport.

It is yet another object of the invention provide a tool for transferring hinges to a new door that is both inexpensive and simple to use.

These and other objects of the invention, will be apparent to one of ordinary skill in the art after reviewing the disclosure of which invention.

SUMMARY OF THE INVENTION

The invention provides an alignment device allowing hinges from an old door being replaced to be transferred to a new door in the corresponding position to ensure that the new door is properly aligned in the door frame. The tool has an elongate channel that is placed next to the door in the height direction. A stopper aligns a comparable tool with a top edge of the door having its hinges removed. Brackets secure the channel to the door and ensure that the channel is parallel to the door. Once the tool is fixed relative to the door, the hinges can be attached to the channel. After the hinges are attached to the channel, they are removed from the existing door. The tool can now use to install hinges on a new door. There is no further use of the old door, allowing the use of the tool to mount hinges on the new door at a remote time or place from the hinges.

The tool can be made out of any suitable material, such as metal or plastic. The tool needs to be rigid enough to support its own weight and the weight of hinges without undue bending. The tool is properly aligned with an existing door before having hinges from the existing door attached. Thereafter, the tool is aligned with the new door in the same manner, ensuring that the hinges attached to the tool are now at the proper location for installation to the new door. Once the hinges are installed on the new door, the door can be mounted in the frame. Once the hinges are placed within the existing recesses for the hinges, the door will fit properly within the frame.

DETAILED DESCRIPTION OF THE INVENTION

Figure 1:
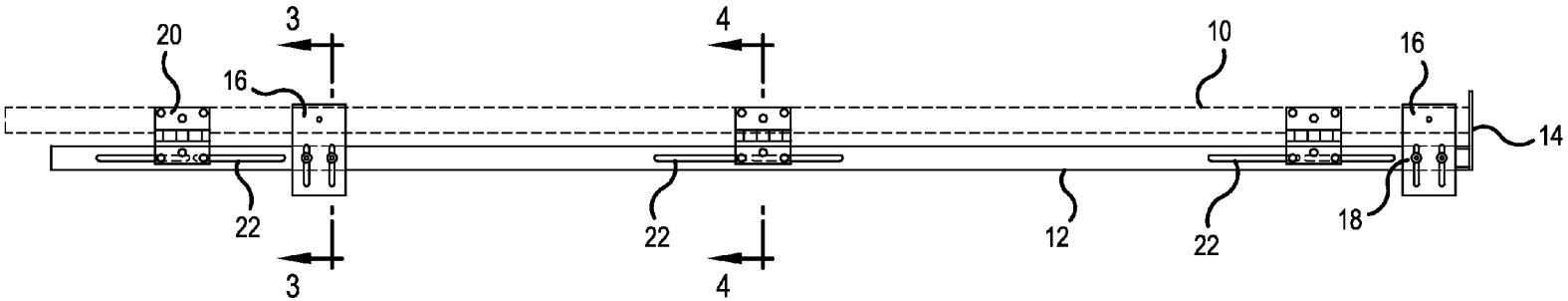
FIG. 1 is a top view of the alignment device.
Figure 3:
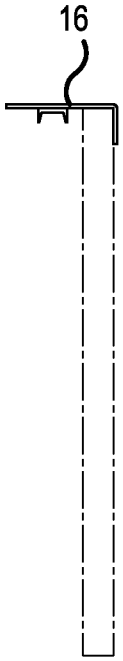
FIG. 3 is a cross sectional view along line 3-3 of FIG. 1.
Figure 4:
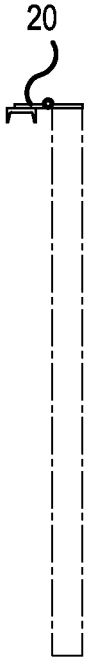
FIG. 4 is a cross sectional view along line 4-4 of FIG. 1.

FIG. 1 depicts a top view of the tool connected to a door 10. As will be explained, the door 10 can be the old door being replaced or the new door to be installed. The door is first removed from the frame and a channel 12 is aligned parallel with the door. The channel 12 only needs to be longer than the distance between the top edge of the door and the bottom hinge. The channel is preferably rigid enough so that is can support its own weight without bending, especially when supported at only one end. The use of metal angle iron is contemplated. The angle iron has a main surface with a depending flange along each side edge, as best seen in the cross sectional views of FIGS. 3 and 4. However, the channel 12 may be formed from plastic or carbon fiber materials, as well.

Figure 2:
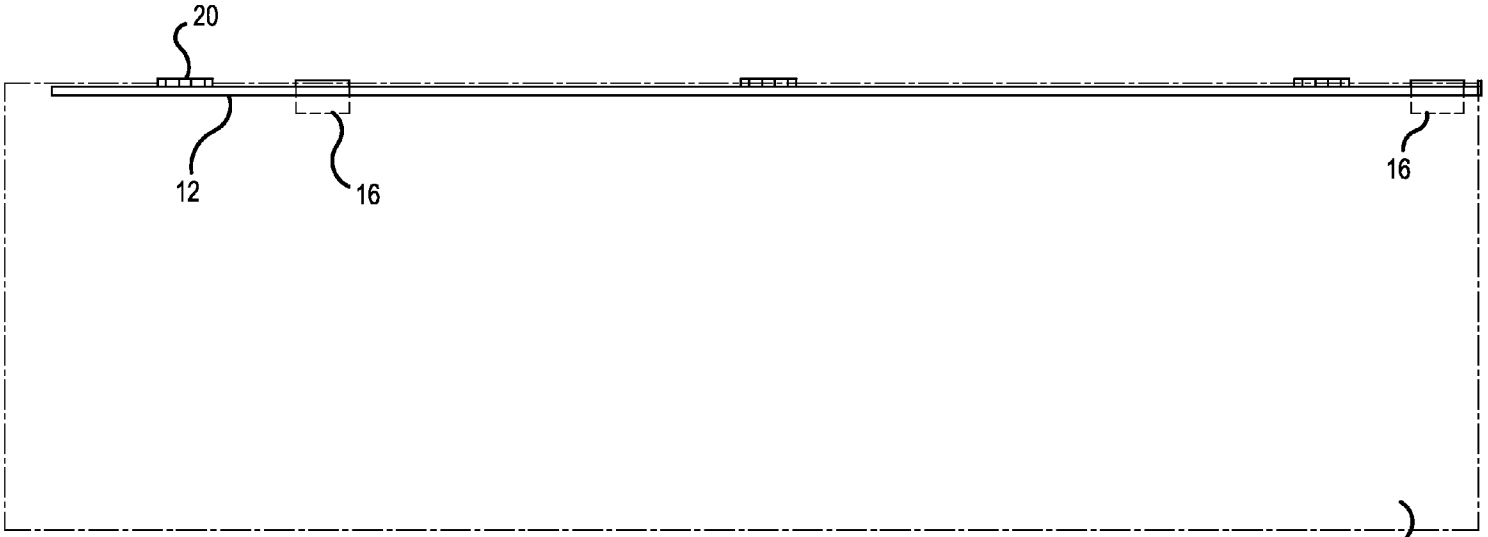
FIG. 2 is a side view of the alignment device.

The channel is then connected to the door by brackets 16. The bracket is first temporarily connected to the door by any suitable means, such as a wood screw. As best seen in the side view of FIG. 2, the bracket may have a depending flange contacting the front surface of the door. The flange is not necessary, but increases the ease in aligning the channel with the door before the bracket is attached. Particularly, the use of two identical brackets having flanges ensures that the channel 12 is parallel with the door by simply having the flanges contact the front surface of the door 10. Each bracket has at least one slot and a fastener 18 extending from the channel 12 and through the slot 16. One slot simplifies the tightening process, but two slots prevent the bracket from rotating. A threaded shaft extending from the channel with a threaded fastener which is tightened to contact the bracket provides enough force to secure the bracket relative to the channel. The fastener 18 can be tightened to fix the position of the bracket relative to the channel, or can be loosened to allow the channel to move relative to the bracket in a direction toward or away from the door. The ability of the channel to move in this direction allows slots 22 in the channel 12 to be aligned with the screw holes in the door hinges 20, as will be explained later.

The channel also needs to be aligned with the top of the door. A stopper 14 extends from the end of the channel 12. The stopper is placed up against the top of the door, as best seen in FIG. 1. The stopper provides a simple, sure means of aligning the channel with door. The stopper can be permanently or removable attached to the channel 12 by any suitable means, such as bolts. If removably attached, the stopper can be attached to either end of the channel. In addition, the brackets 16 and stopper can be affixed to extend from the channel in either direction.

Other stoppers could be used. The bracket 16 nearest the top of the door can be use for alignment by having an edge, such as the right edge in FIG. 1, aligned with the top edge of the door. This edge can also be provided with a flange to contact the top edge of the door to further increase the ease in aligning the channel with the top of the door. The brackets are secured to the door after the channel is aligned with the top edge, and then the bracket and channel are adjusted to align slots 22 with the screw holes in the hinges 20.

Once the channel is aligned with and secured to the door, the hinges 20 are still connected to the door. The hinges have their free halves connected to slots 22 within the channel 12. The hinges typically have three screw holes, and two of the screw holes will be along a line parallel to the door. Therefore, the channel is connected so that these two screw holes are aligned with the slots 22. The slots are placed along the channel to correspond to the location where three hinges will be located when the tool is attached the door. The use of slots provides the ability to accommodate a wide range of hinge placements on the door to ensure the hinges can be attached to the channel. Therefore the three sets of slots 22 are formed in the channel at positions corresponding to these locations. Three sets of slots are depicted, as most residential doors have three hinges. However, taller doors may have four hinges, and a longer channel having four sets of slots can be used for these types of doors. It is also possible to have just two sets of slots. Once the hinges are suitably secured to the channel, the screws connecting the hinge to the door are removed from the old door. At this point, the old door is taken away and the device has the hinges connected thereto. The old door is no longer needed, and the tool, having the hinges attached, can be used to attach the hinges to the new door at any given time or location.

To install the hinges to the new door, the process is reversed. The channel is aligned with the new door by having the stopper 14 engage the top of the door, and the brackets 16 are attached to the new door. The hinges are now aligned in their correct location on the new door, corresponding to their position on the original door. The free half of the hinges not connected to the channel are now connected to the new door and the hinges are then released from the channel 12. The hinges are now in the correct position, and hinges are connected to door frame. This ensures that the door will be correctly aligned and positioned within the door frame.

The invention has been described with reference to a preferred embodiment. Variations and modifications would be apparent to one of ordinary skill in the art. The invention encompasses such variations and modifications.

I claim:

1. A tool for removing and installing hinges, comprising:

an elongated member having a first end and a second end, the second end spaced from the first end in a longitudinal direction;

a stopper at the first end of the elongated member for aligning the tool with an edge of a door;

a bracket connected to the elongated member, the bracket being movable relative to the elongated member in a direction perpendicular to the longitudinal direction; and at least two slots formed in the elongated member, the slots extending in the longitudinal direction.

2. The tool of claim 1, further comprising:

a threaded shaft extending from the elongated member; and a slot formed in the bracket, the slot in the bracket extending in a direction perpendicular to the longitudinal direction, wherein the threaded shaft extends through the slot in the bracket.

3. The tool of claim 1, wherein a flange extends from an end of the bracket distal to the elongated member.

4. The tool of claim 1, wherein the stopper is a side edge of the bracket.

5. The tool of claim 1, wherein the stopper is a bar ending from an end of the elongated member.

6. The tool of claim 1, wherein the stopper is removably attached to the elongated member.

7. The tool of claim 6, wherein the stopper is attached to either end of the elongated member.

8. A tool for removing and installing hinges, comprising an elongated member having a first end and a second end, the second end spaced form the first end in a longitudinal direction;

means for aligning the tool with an edge of a door;

means for connecting the elongated member to the door; and means for attaching hinges to the door.

* * * * *